US006381765B1

(12) United States Patent
Liu

(10) Patent No.: US 6,381,765 B1
(45) Date of Patent: May 7, 2002

(54) DUAL-MODE FLUSHING CONTROL MECHANISM FOR BALLFLOAT TOILET

(76) Inventor: Li-Ching Liu, 7, Lane 12, Kuo Chi Erh Road, Yingko, Taipei Hsien (TW)

( * ) Notice: Subject to any disclaimer, the term of this patent is extended or adjusted under 35 U.S.C. 154(b) by 0 days.

(21) Appl. No.: 09/799,534

(22) Filed: Mar. 7, 2001

(51) Int. Cl.[7] ..... E03D 1/35
(52) U.S. Cl. ..... 4/404; 4/393; 4/415
(58) Field of Search ..... 4/404, 403, 393, 4/415

(56) References Cited

U.S. PATENT DOCUMENTS 4,937,894 A * 7/1990 Hill, Jr., et al. ..... 4/404 X
5,138,725 A * 8/1992 Fernstrum, Jr. ..... 4/393
5,390,375 A * 2/1995 Fernstrum, Jr. ..... 4/404
6,173,457 B1 * 1/2001 Higgins ..... 4/393

* cited by examiner

*Primary Examiner*—David J. Walczak
*Assistant Examiner*—Kathleen J. Prunner
(74) *Attorney, Agent, or Firm*—Troxell Law Office PLLC

(57) ABSTRACT

A control mechanism for a toilet is constructed to include a valve seat, an overflow tube, and a tank ball assembly pivoted to the overflow tube and adapted to close/open the valve seat. The tank ball assembly includes a holder base pivoted to the overflow tube, a stopper pivoted to the holder base, an adjustment valve fastened to a bottom side of the stopper, a first lift chain adapted to lift the holder base with the stopper and the adjustment valve from the valve seat for enabling a first amount of flushing water to be discharged out of the valve seat, and a second lift chain adapted to lift the stopper with the adjustment valve from the holder base for enabling a second amount of flushing water to be discharged out of the valve seat.

3 Claims, 8 Drawing Sheets

DUAL-MODE FLUSHING CONTROL MECHANISM FOR BALLFLOAT TOILET

BACKGROUND OF THE INVENTION

The present invention relates to a ball float toilet and, more specifically, to a dual-mode flushing control mechanism for a ball float toilet, which can conveniently be controlled to let two different volumes of flushing water be selectively discharged out of the valve seat of the tank of the ball float toilet.

In order to save the consumption of water, a ball float toilet may be provided with two operation modes for enabling different amounts of flushing water to be selectively discharged out of the valve seat of the tank. However, the overflow tube for this design must have two water inlets disposed at different elevations. When changing a conventional ball float toilet to fit two operation modes, the overflow tube must be replaced with a new one that has two controllable water inlets arranged at different elevations. Because this changing work requires a special technique, only an experienced plumber or wireman can do the job. Further, because the two water inlets are fixedly provided at different elevations, their positions cannot be changed to adjust the flushing water level.

SUMMARY OF THE INVENTION

The present invention has been accomplished under the circumstances in view. It is one object of the present invention to provide a dual-mode flushing control mechanism for a ball float toilet, which can conveniently be controlled to let two different volumes of flushing water be selectively discharged out of the valve seat of the ball float toilet. It is another object of the present invention to provide a dual-mode flushing control mechanism for a ball float toilet, which can conveniently be adjusted to change the flushing speed. According to one aspect of the present invention, the dual-mode flushing control mechanism for a ball float toilet is constructed to include a valve seat, an overflow tube, a tank ball assembly pivoted to the overflow tube and adapted to close/open the valve seat. The tank ball assembly includes a holder base pivoted to the overflow tube, a stopper pivoted to the holder base, an adjustment valve fastened to a bottom sidewall of the stopper, a first lift chain adapted to lift the holder base with the stopper and the adjustment valve from the valve seat for enabling a first amount of flushing water to be discharged out of the valve seat, and a second lift chain adapted to lift the stopper with the adjustment valve from the holder base for enabling a second amount of flushing water to be discharged out of the valve seat. According to another aspect of the present invention, the adjustment valve comprises a hollow valve body fastened to the stopper, the hollow valve body having an elongated, arched bottom water passage hole, and a rotary cap fastened to the valve body and rotated on the valve body to adjust the opening of the elongated, arched bottom water passage hole of the valve body and to further change the flushing time when lifting the holder base or the stopper from the valve seat for letting water be discharged out of the valve seat.

DETAILED DESCRIPTION OF THE PREFERRED EMBODIMENT

Figure 1:
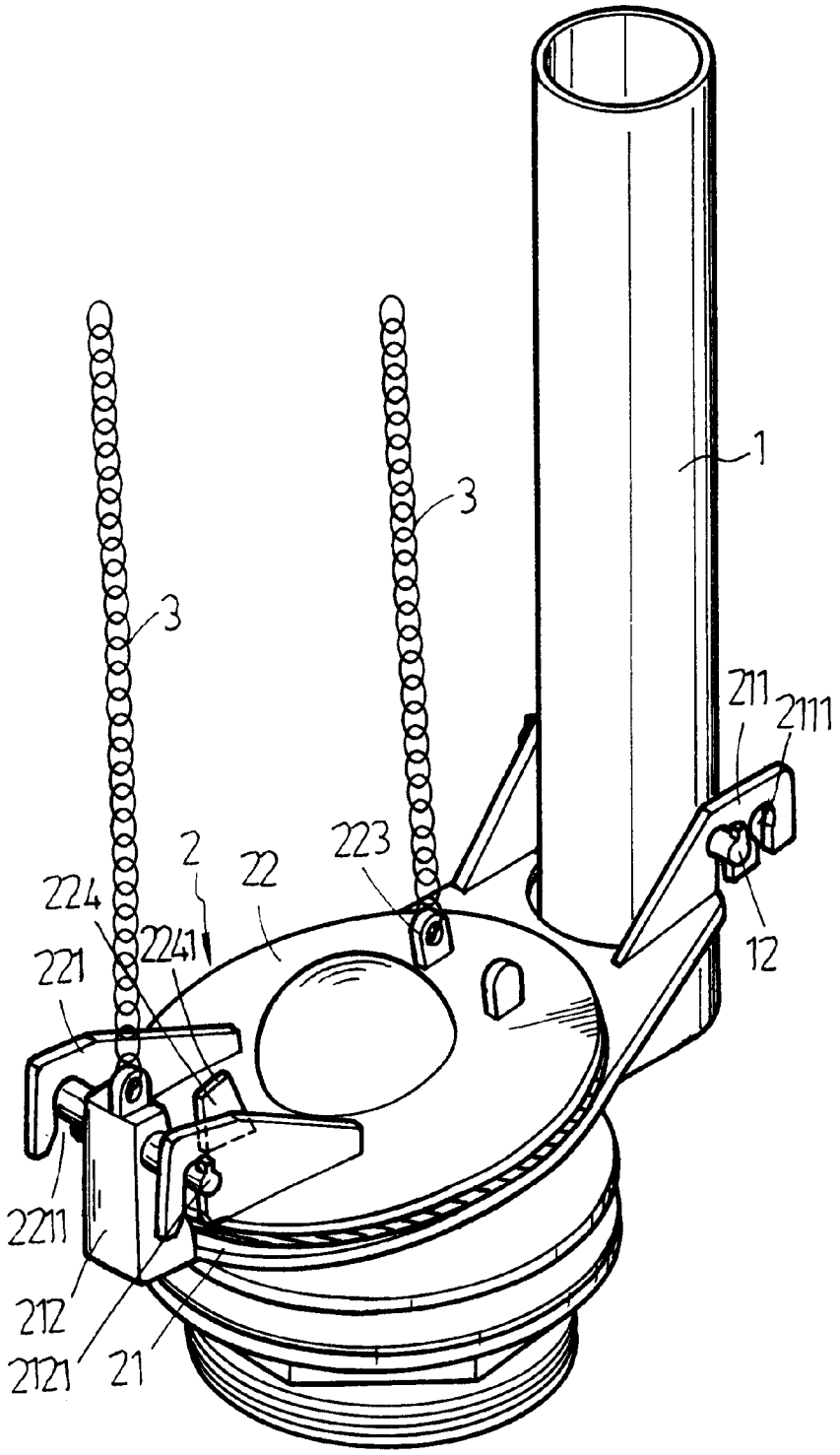
FIG. 1 is a perspective view of the dual-mode flushing control mechanism for a ball float toilet according to the present invention.
Figure 2:
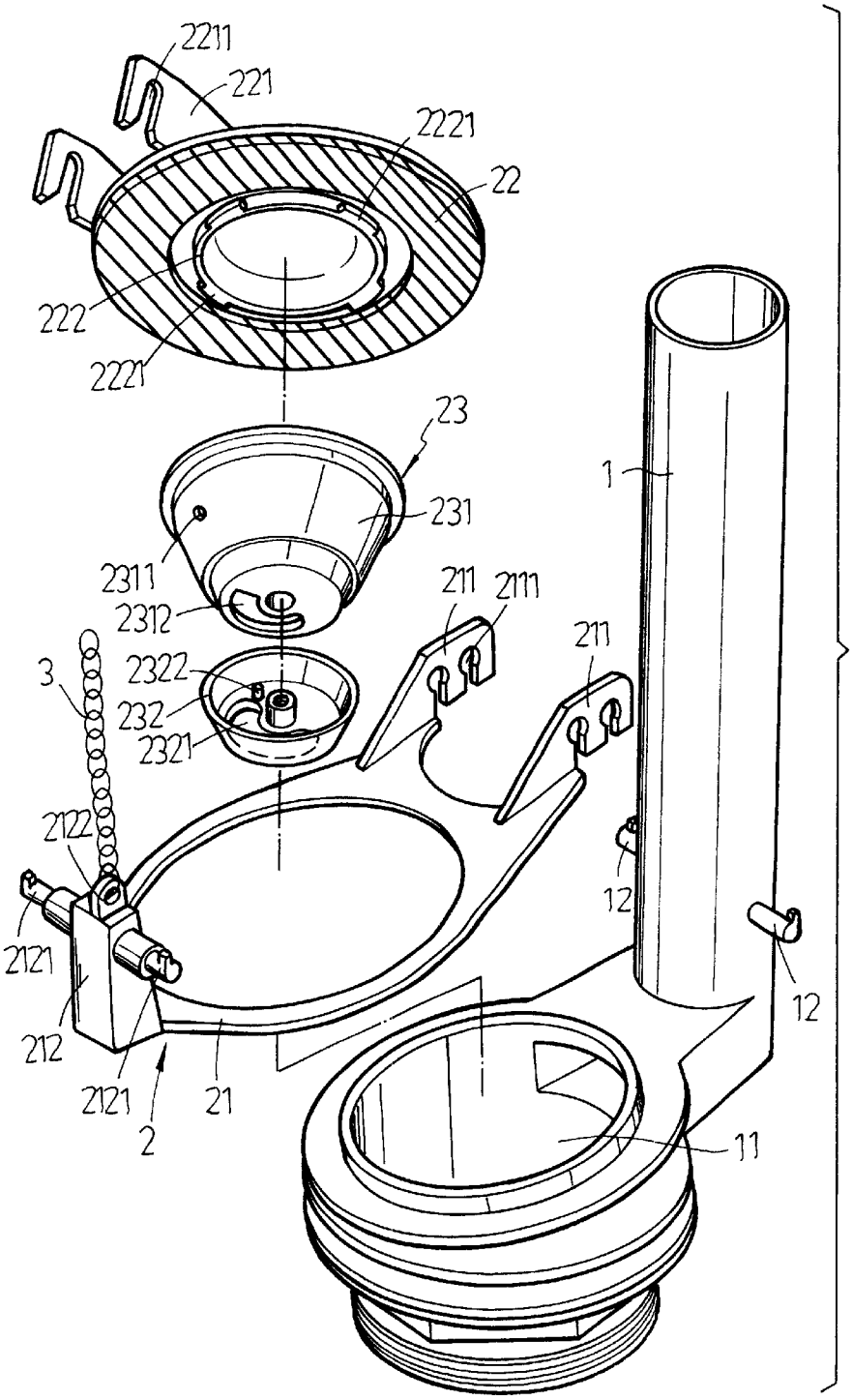
FIG. 2 is an exploded view of the dual-mode flushing control mechanism for ball float toilet shown in FIG. 1.

Referring to FIGS. from 1 through 3, a dual-mode flushing control mechanism for a ball float toilet in accordance with the present invention is shown comprising a valve seat 11, an overflow tube 1 disposed at one side of the valve seat 11, and a tank ball assembly 2 pivoted to the overflow tube 1 and adapted to close the valve seat 11. The overflow tube 1 comprises two pivot rods 12 horizontally disposed on opposite sides near the bottom end thereof above the elevation of the valve seat 11. The tank ball assembly 2 comprises a holder base 21, a stopper 22, and an adjustment valve 23. The holder base 21 is a hollow frame fitting over the valve seat 11, comprising two parallel coupling arms 211 disposed at one end thereof and an upright block 212 disposed at the other end thereof. The parallel arms 211 each have a plurality of bottom coupling slots 2111 selectively and pivotally coupled to the pivot rods 12 of the overflow tube 1. The upright block 212 comprises two pivot rods 2121 horizontally aligned at two sides thereof, and an eyelet 2122 disposed at the topside thereof. The stopper 22 comprises two backwardly extended parallel coupling arms 221, the coupling arms 221 each having a coupling notch 2211 respectively coupled to the pivot rods 2121 of the upright block 212 of the holder base 21, an upright stop plate 224 extended from the top sidewall thereof and spaced between the parallel coupling arms 221, a top eyelet 223 extended from the top sidewall and disposed near the periphery thereof remote from the stop plate 224, an annular coupling flange 222 extended from the bottom sidewall thereof, and a plurality of locating blocks 2221 respectively formed integral with the outside wall of the annular coupling flange 222. The adjustment valve 23 comprises a hollow valve body 231 fastened to the locating blocks 2221 of the annular coupling flange 222 of the stopper 22, and a rotary cap 232 coupled to the bottom end of the valve body 231. The valve body 231 comprises an elongated, arched bottom water passage hole 2312, and a side air vent 2311 extended through the peripheral wall thereof at one side facing the upright block 212 of the holder base 21. The rotary cap 232 comprises an elongated, arched bottom through hole 2321, and a stop rod 2322 disposed at one side of the elongated, arched bottom through hole 2321 and inserted into the elongated, arched bottom water passage hole 2312 of the valve body 231. Further, two lift chains 3 are respectively connected to the eyelets 2122 and 223, and adapted to lift the holder base 21 and the stopper 22 respectively.

Figure 3:
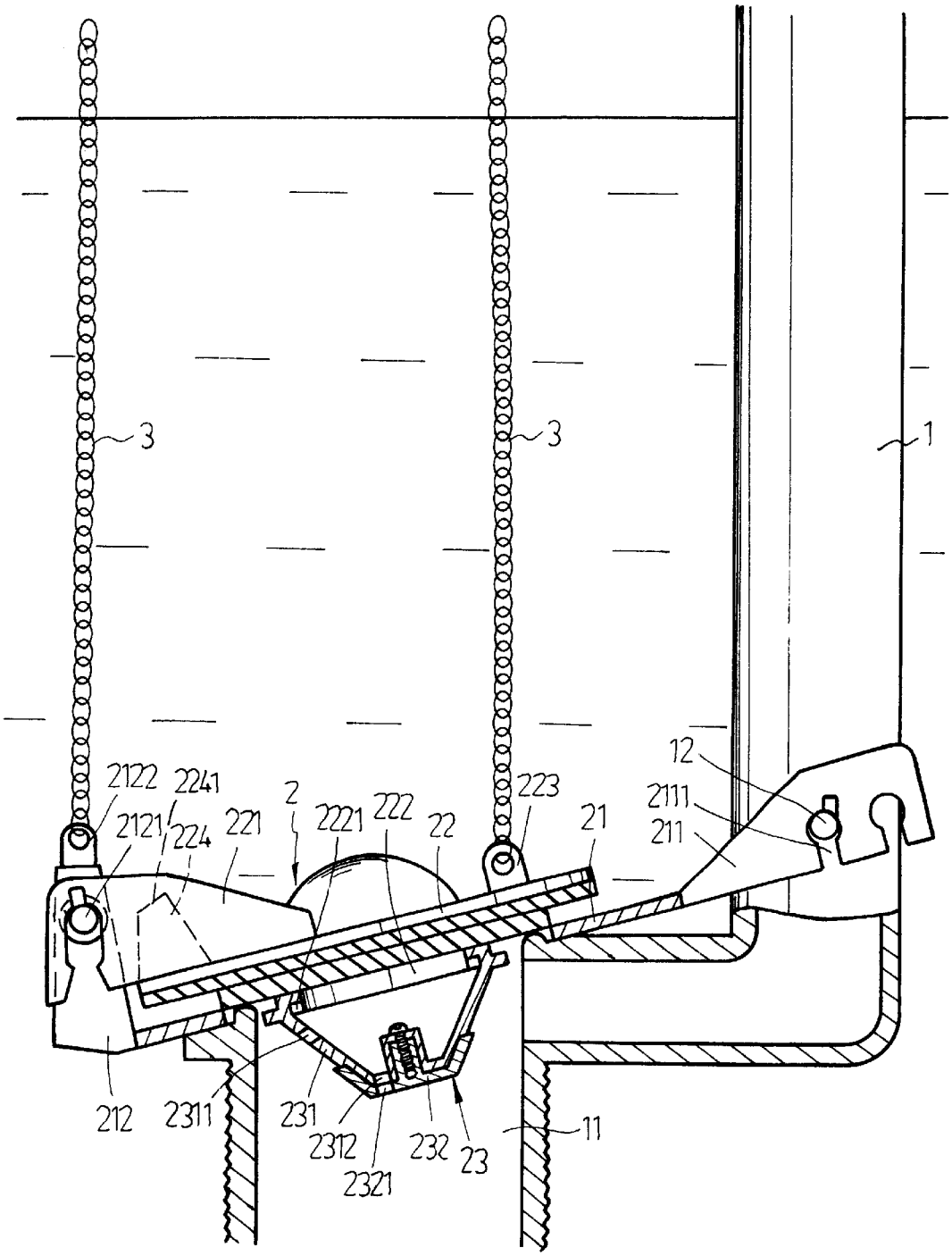
FIG. 3 is a sectional assembly view of the dual-mode flushing control mechanism according to the present invention.
Figure 7:
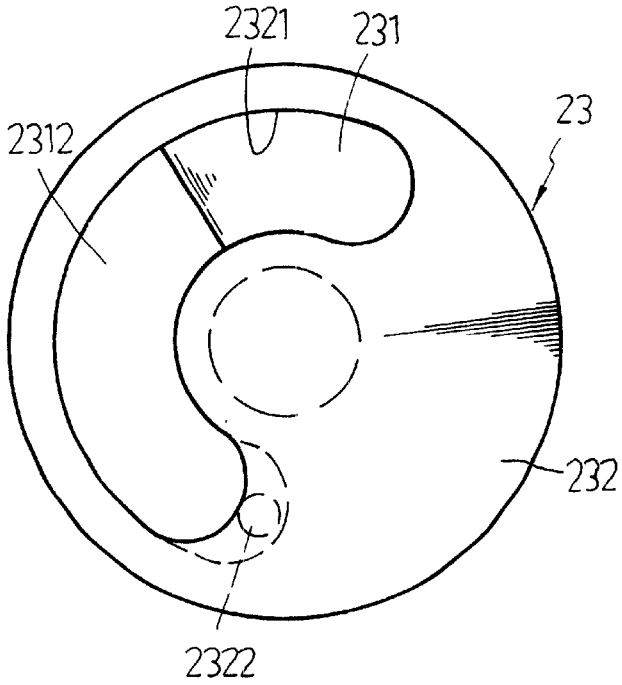
FIG. 7 is a schematic drawing showing the rotary cap rotated on the valve body to the open position.
Figure 8:
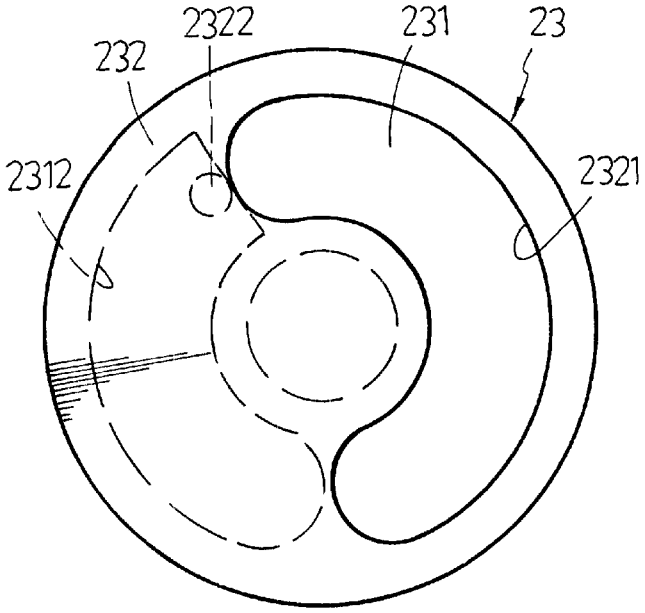
FIG. 8 is a schematic drawing showing the rotary cap rotated on the valve body to the close position.

Referring to FIGS. 7 and 8 and FIG. 3 again, the rotary cap 232 can be rotated on the valve body 231 to move the elongated, arched bottom through hole 2321 relative to the elongated, arched bottom water passage hole 2312 of the valve body 231. The stop rod 2322 limits the rotary angle of the rotary cap 232 relative to the valve body 231. By means of adjusting the angular position of the rotary cap 232 on the valve body 231, the water passage through the adjustment valve 23 to the valve seat 11 is relatively adjusted.

Figure 4:
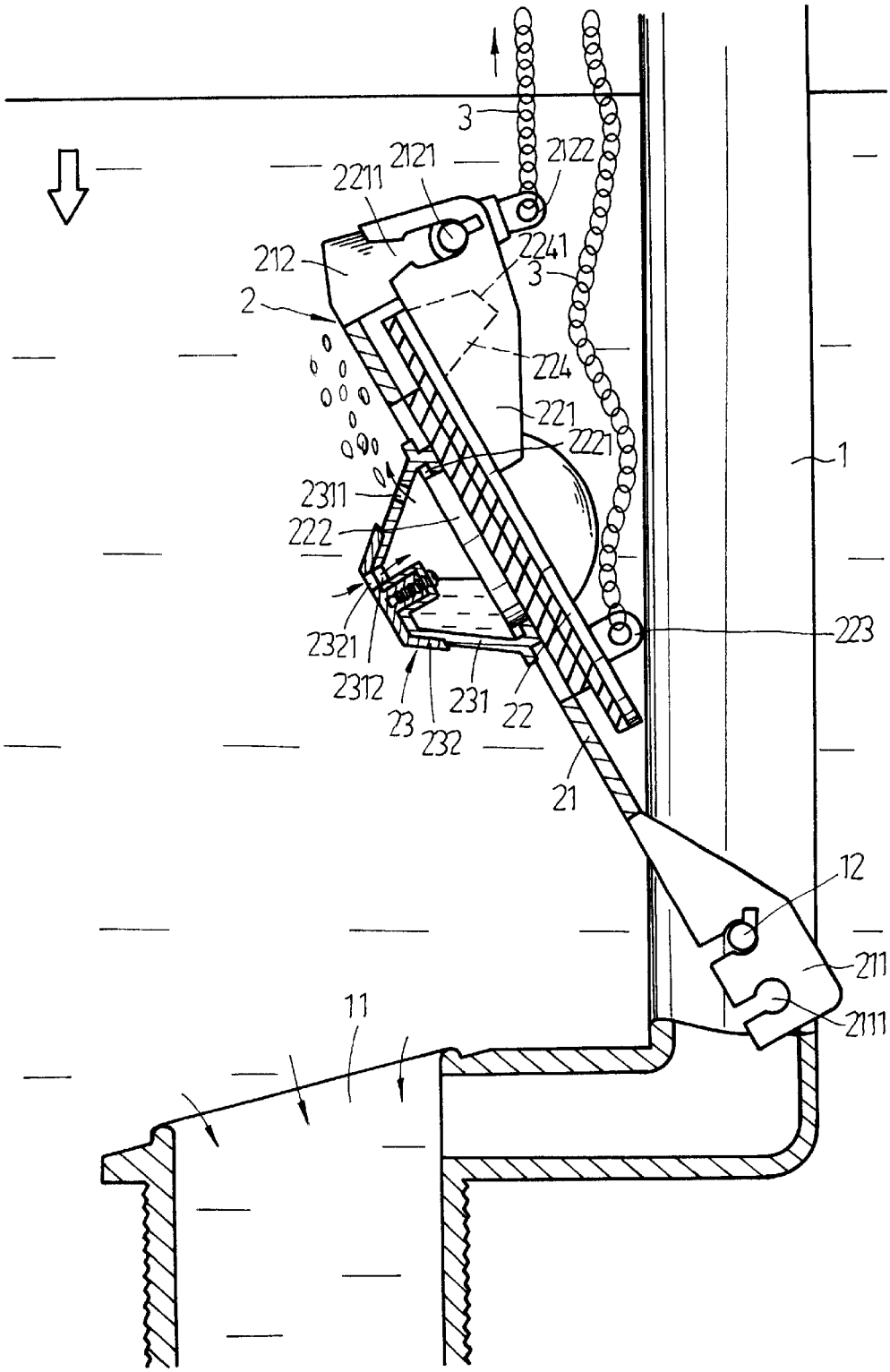
FIG. 4 is an operational view of the present invention showing a small amount of flushing water discharging operation.

Referring to FIG. 4 and FIG. 3 again, when turning the trip handle of the ball float toilet downwards to the first position to discharge a small amount of flushing water, the lift chain 3 at the eyelet 2122 of the upright block 212 of the holder base 21 is lifted to turn the holder base 21 about the pivot rods 12 of the overflow tube 1, thereby causing the stopper 22 to be moved with the holder base 21 obliquely upwardly away from the valve seat 11. At this time, the eyelet 223 of the stopper 22 is stopped against the periphery of the overflow tube. 1 to stop the holder base 21 from further upward movement. Because the valve body 231 has an air vent 2311, water flows through the elongated, arched bottom water passage hole 2312 and the elongated, arched bottom through hole 2321 into the valve body 231 when lifting the adjustment valve 23 from the valve seat 11. Because the air vent 2311 is moved to the topside after the adjustment valve 23 has been lifted from the valve seat 11, air is expelled out of the valve body 231 through the air vent 2311. If the opening of the combined hole of the elongated, arched bottom water passage hole 2312 and the elongated, arched bottom through hole 2321 is adjusted wider, the flowing speed of intake water is relatively quicker. Therefore, the amount of flushing water passing out of the valve seat 11 depends on the speed of the stopper 22 in closing the valve seat 11, i.e., the speed of water flowing into the valve body 231. Further, after flushing of the small amount of flushing water, inside water flows directly from the valve body 231 through the elongated, arched bottom water passage hole 2312 and the elongated, arched bottom through hole 2321 to the valve seat 11, keeping the adjustment valve 23 empty without water.

Figure 5:
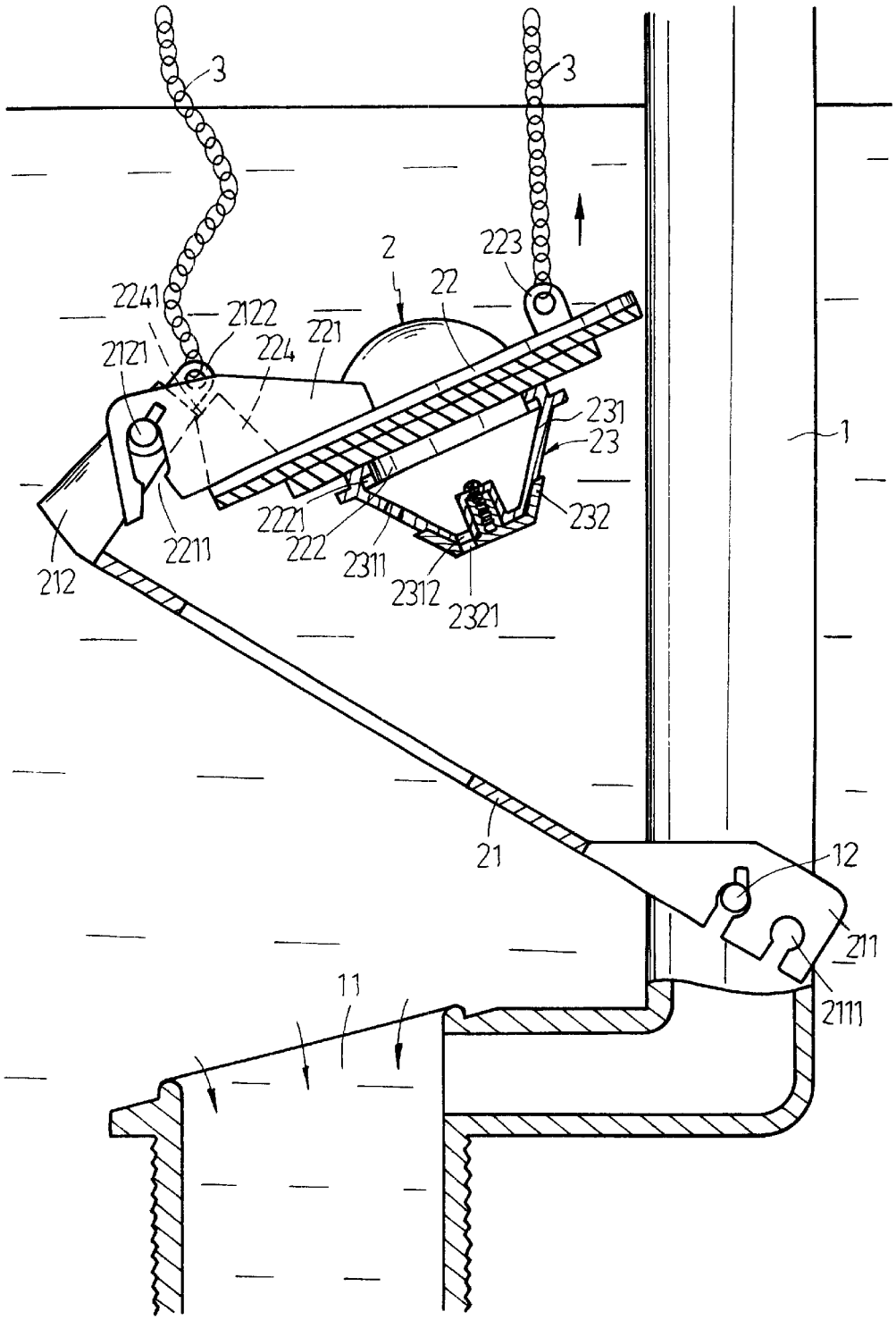
FIG. 5 is an operational view of the present invention showing a big amount of flushing water discharging operation (I).
Figure 6:
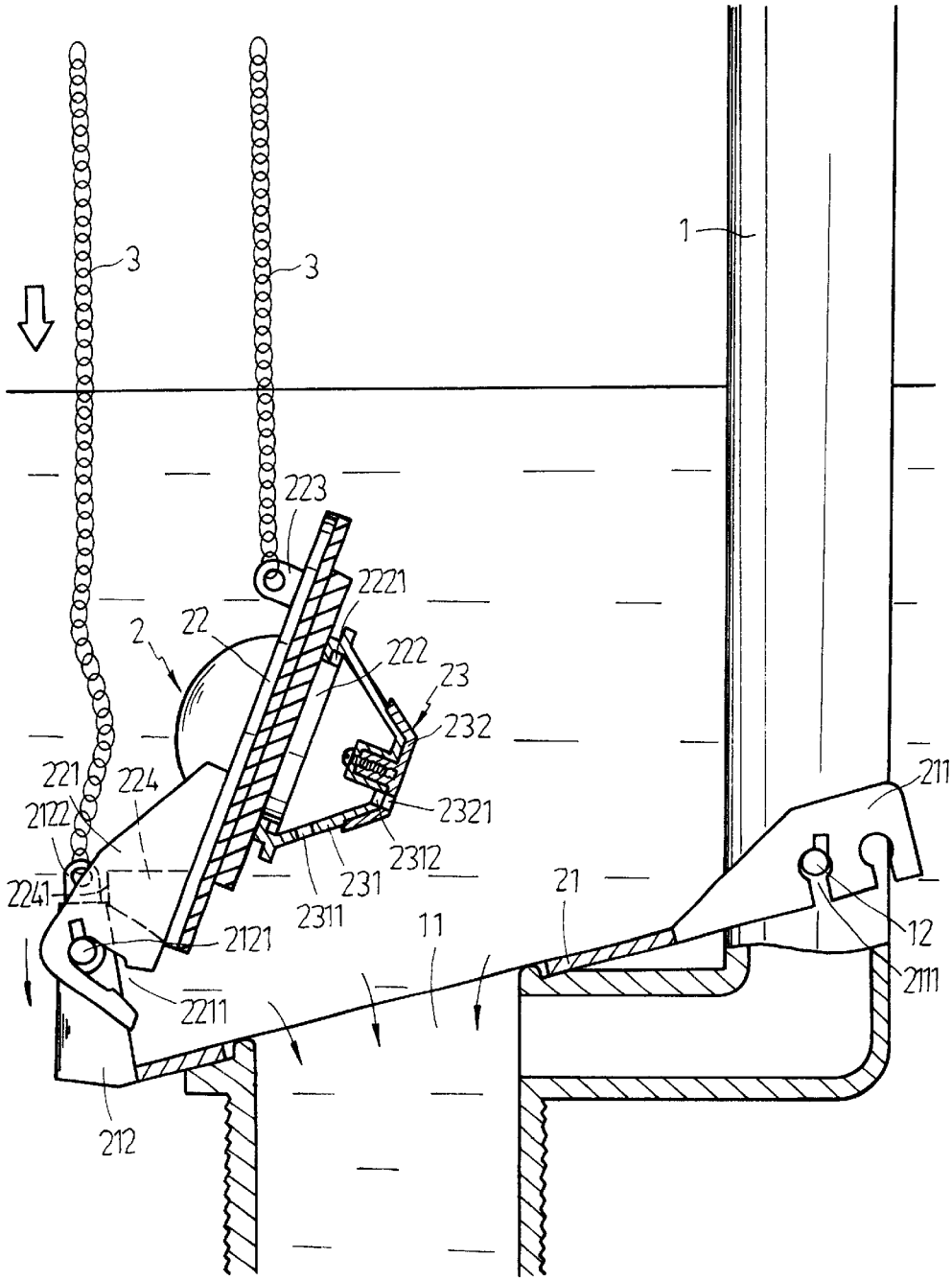
FIG. 6 is an operational view of the present invention showing a big amount of flushing water discharging operation (II).

Referring to FIGS. 5 and 6, when turning the trip handle of the ball float toilet downwards to the second position to discharge a big amount of flushing water, the lift chain 3 at the stopper 22 is lifted to open the stopper 22 from the holder base 21. When turning the stopper 22 upwardly about the pivot rods 2121 of the upright block 212, the beveled top edge 2241 of the stop plate 224 will be stopped against the upright block 212 to limit the turning angle of the stopper 22. At this time, the air vent 231 is moved to the bottom side, and air is prohibited from escaping out of the valve body 231 through the air vent 2311, therefore the valve body 231 is maintained empty without water and, the adjustment valve 23 is kept floating in the tank water above the elevation of the valve seat 11, for enabling a big amount of tank water to be discharged out of the tank through the valve seat 11. Thereafter, the flexible stopper 22 is lowered smoothly following the reduction of water level in the tank, and then sucked by a vacuum suction force to close the valve seat 11, for enabling the tank of the ball float toilet to be filled up with water again.

Figure 9:
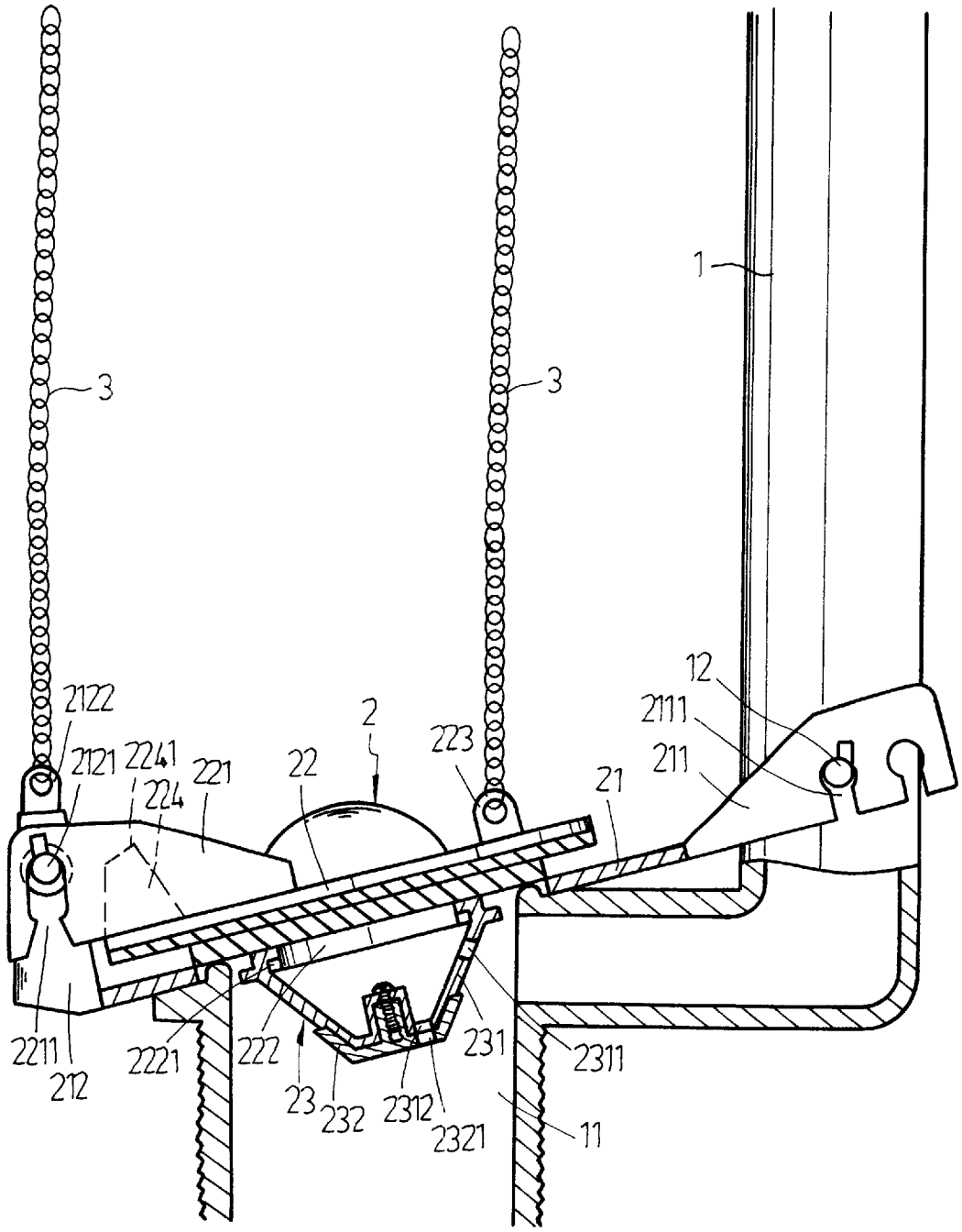
FIG. 9 is a sectional view showing an alternate form of the present invention.

Referring to FIG. 9, the air vent 2311 of the rotary cap 232 of the adjustment valve 23 can be disposed at the other side facing the overflow tube 1. According to this arrangement, a small amount of flushing water is discharged out of the tank of the ball float toilet through the valve seat 11 when lifting the holder base 21 from the valve seat 11, and a big amount of flushing water is discharged out of the tank of the ball float toilet through the valve seat 11 when lifting the stopper 22 and the adjustment valve 23 from the holder base 21.

A prototype of a dual-mode flushing control mechanism for a ball float toilet has been constructed with the features of FIGS. 1–9. The dual-mode flushing control mechanism for a ball float toilet functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A tank ball assembly for use in a dual-mode flushing control mechanism for a ball float toilet having a valve seat installed in the tank of the toilet for guiding water out of the tank and an overflow tube mounted inside the tank at one side of the valve seat and being provided with two opposite pivot rods extending outwardly therefrom, the tank ball assembly comprising:

a hollow holder base adapted to fit over said valve seat and including a first end having coupling arms extending outwardly therefrom, each coupling arm being provided with two pivot slots bilaterally and perpendicularly extending from the periphery thereof and adapted to be fitted to and pivoted about said two opposite pivot rods of said overflow tube, a second end being provided with an upright block adapted to be connected to a first lift chain for enabling said holder base to be lifted off of said valve seat about the pivot rods of said overflow tube, said upright block having two pivot rods horizontally aligned and extending from opposite sides thereof;

a stopper pivoted to the pivot rods of said upright block of said holder base and adapted to open and close said valve seat, said stopper including an eyelet extending from its top surface at an end remote from said upright block of said holder base and adapted to be connected to a second lift chain for enabling said stopper to be lifted upwardly about the pivot rods of said upright block to open said valve seat, an annular coupling flange extending from the bottom surface of said stopper and being provided with a plurality of locating blocks formed integrally with said annular coupling flange; and an adjustment valve fastened to said stopper and adapted to be inserted into said valve seat to close said valve seat, said adjustment valve including a hollow valve body covering said annular coupling flange and fastened to the locating blocks on said annular coupling flange, said valve body being provided with an elongated, arched bottom water passage hole in a bottom side of said valve body, a rotary cap covering said bottom side of said valve body and being provided with an elongated, arched bottom through hole, said rotary cap being rotated on said valve body between two positions to open said elongated, arched bottom water passage hole of said valve body when said arched holes coincide and to close said elongated, arched bottom water passage hole of said valve body when said arched holes do not coincide.

2. The tank ball assembly of claim 1 wherein said hollow valve body comprises an air vent longitudinally spaced from said elongated, arched bottom water passage hole of said valve body for enabling air to be expelled out of said valve body when said holder base is lifted with said first lift chain from said valve seat causing said vent to face upwardly and for preventing air from escaping out of said valve body when said stopper is lifted with said second chain from said holder base causing said vent to face downwardly.

3. The tank ball assembly of claim 1 wherein said stopper comprises an upright stop plate adapted to be stopped against the upright block of said holder base to limit the upward turning angle of said stopper when said stopper is lifted with said second lift chain and said eyelet of said stopper is adapted to be stopped against said overflow tube to limit the upward turning angle of said stopper when said holder base is lifted with said first lift chain.

* * * * *